US008086130B2

(12) United States Patent
Furukawa

(10) Patent No.: US 8,086,130 B2
(45) Date of Patent: Dec. 27, 2011

(54) IMAGE FORMING APPARATUS HAVING FAN FOR SUPPLYING AIR TO RECORDING SHEET HAVING PASSED THROUGH FIXING UNIT

(75) Inventor: Toshio Furukawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 352 days.

(21) Appl. No.: 12/369,263

(22) Filed: Feb. 11, 2009

(65) Prior Publication Data

US 2009/0202268 A1 Aug. 13, 2009

(30) Foreign Application Priority Data

Feb. 12, 2008 (JP) ..... 2008-030695

(51) Int. Cl.
*G03G 21/20* (2006.01)
*G03G 15/20* (2006.01)
*G03G 15/00* (2006.01)

(52) U.S. Cl. ..... 399/92; 399/341; 399/401

(58) Field of Classification Search ..... 399/92, 399/322, 341, 401
See application file for complete search history.

(56) References Cited

U.S. PATENT DOCUMENTS 4,959,693 A * 9/1990 Mitsuya et al. ..... 399/322
6,741,815 B1 5/2004 Fujita et al.
2007/0059023 A1* 3/2007 Koshida ..... 399/92
2007/0280721 A1* 12/2007 Kanai ..... 399/92

FOREIGN PATENT DOCUMENTS

| | | | |
|---|---|---|---|
| JP | 7-172652 | A | 7/1995 |
| JP | 8-239153 | A | 9/1996 |
| JP | 2000-187417 | A | 7/2000 |
| JP | 2000-264494 | A | 9/2000 |
| JP | 2002-278354 | A | 9/2002 |
| JP | 2002-304107 | A | 10/2002 |
| JP | 2003-295741 | A | 10/2003 |
| JP | 2003-307959 | A | 10/2003 |
| JP | 2003-316237 | A | 11/2003 |
| JP | 2005-196079 | A | 7/2005 |
| JP | 2005-227454 | A | 8/2005 |
| JP | 2006-091095 | A | 4/2006 |
| JP | 2006-091705 | A | 4/2006 |
| JP | 2006-330377 | A | 12/2006 |
| JP | 2007-065090 | A | 3/2007 |
| JP | 2007-253480 | A | 10/2007 |

* cited by examiner

*Primary Examiner* — Sandra Brase
(74) *Attorney, Agent, or Firm* — Banner & Witcoff, Ltd.

(57) ABSTRACT

An image forming apparatus includes an image formation unit such as a process section for forming an image on a recording sheet. The apparatus may include a fixing unit for fixing the image formed by the image formation unit on the recording sheet, a reversible roller configured to receive the sheet from the fixing unit along a sheet transport path and reverse a transport direction of the sheet, and an air blower, positioned between the fixing unit and the reversible roller along the sheet transport path, configured to blow air in a sheet feeding direction onto the recording sheet on which the image is fixed by the fixing unit.

20 Claims, 9 Drawing Sheets

IMAGE FORMING APPARATUS HAVING FAN FOR SUPPLYING AIR TO RECORDING SHEET HAVING PASSED THROUGH FIXING UNIT

CROSS REFERENCE TO RELATED APPLICATION

This application claims priority from Japanese Patent Application No. 2008-030695, filed on Feb. 12, 2008, the entire subject matter of which is incorporated herein by reference.

FIELD

Aspects of the invention relate to an image forming apparatus configured to form an image on a recording medium, and more specifically to an image forming apparatus configured to fix an image on a recording medium by heat.

BACKGROUND

Known image forming apparatuses are configured to form images on recording media, such as sheets of paper, by causing a recording material, such as toner, to adhere to the recording media by an electrophotographic method. In such image forming apparatuses, images are thermally fixed onto the recording media. When the recording material is toner, thermal fixing causes toner to melt and adhere to the recording medium, so that the image can be formed with stability.

In the image forming apparatuses that perform thermal fixing in this manner, it is proposed to cool a recording medium after thermal fixing by blowing air. For example, in an image forming apparatus that performs duplex printing, it is proposed that air be blown to cool the recording medium after thermal fixing.

However, in the above image forming apparatus, the recording medium that has been fed near the output tray and is fed back is subjected to air almost vertically with respect to a direction where the recording medium is fed back to cool the recording medium, and then an image is formed on a second surface of the recording medium. Unless the recording medium is cooled immediately after thermal fixing, moisture of the recording medium may evaporate by heat to dry the recording medium, and image quality may differ between the first surface and the second surface of the recording medium.

However, when air is blown to the recording medium almost vertically with respect to the sheet feeding direction, if cooling is performed immediately after the recording medium passes through the fixing device that performs thermal fixing, air may also flow to the fixing device, which may interfere with thermal fixing of the image.

SUMMARY

Illustrative aspects of the invention provide an image forming apparatus configured to prevent thermal drying of a recording medium effectively without hindrance to thermal fixing.

BRIEF DESCRIPTION OF THE DRAWINGS

Illustrative aspects will be described in detail with reference to the following figures in which like elements are labeled with like numbers and in which.

DETAILED DESCRIPTION

An illustrative embodiment will be described in detail with reference to the accompanying drawings. An image forming apparatus according to aspects of the invention applies to a laser printer 1 as shown in FIG. 1.

For ease of discussion, in the following description, the top or upper side, the bottom or lower side, the left or left side, the right or right side, the front or front side, and the rear or rear side are used to define the various parts when the laser printer 1 is disposed in an orientation in which it is intended to be used. In FIG. 1, the left side is referred to as the front or front side, the right side is referred to as the rear or the rear side, the up side is referred to as the top or upper side, and the down side is referred to as the bottom or lower side.

Figure 1:
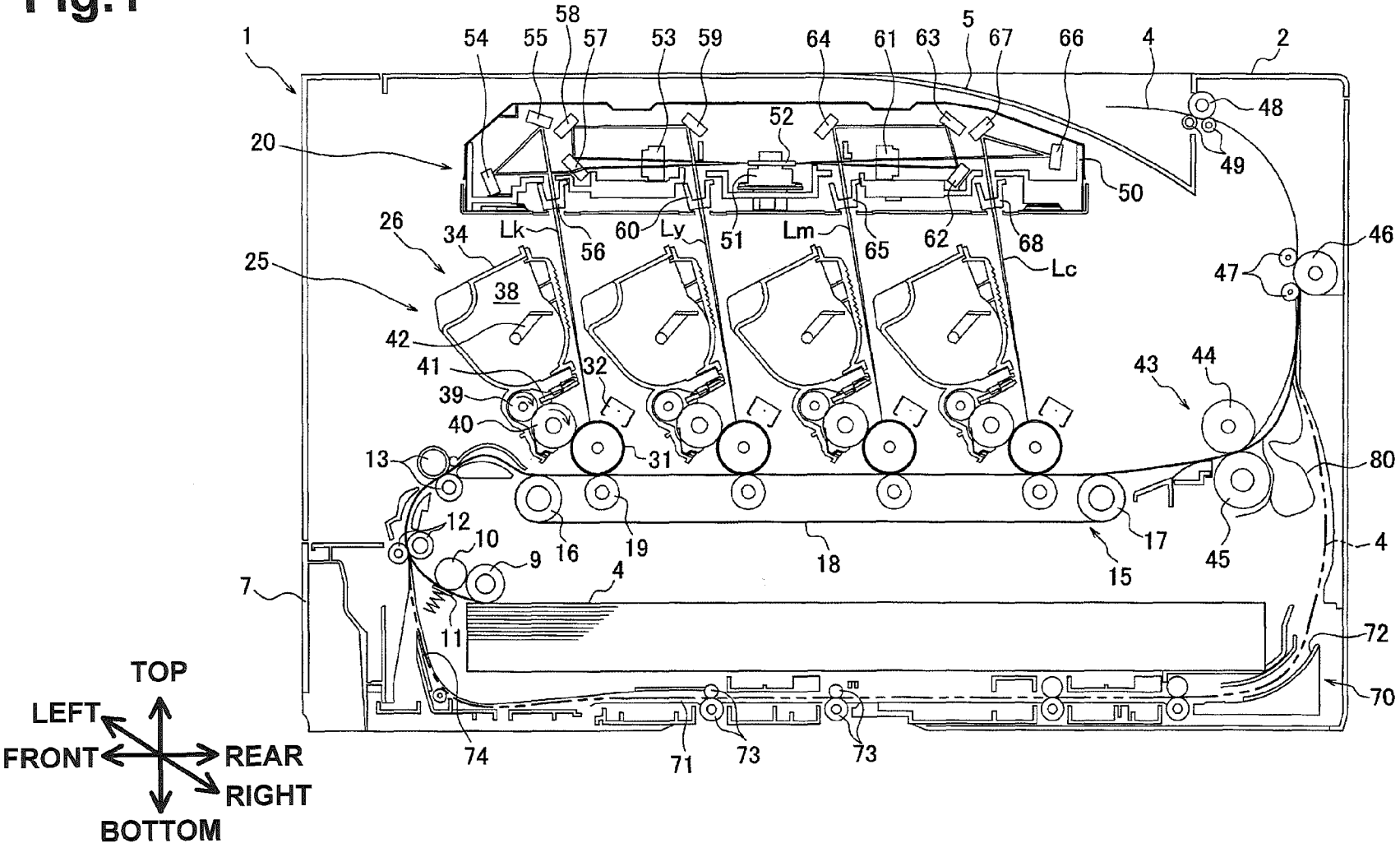
FIG. 1 is a side sectional view of an internal structure of a laser printer as an illustrative example of an image forming apparatus using features described herein.

As shown in FIG. 1, the laser printer 1 is a color laser printer of direct transfer tandem type, and may include a generally box-shaped main body 2. A top surface of the main body 2 contains an output tray 5 on which a recording sheet 4 having an image thereon is placed. A sheet supply cassette 7 may be disposed in a lower portion of the main body 2 and configured to load a stack of sheets 4 therein. The sheet supply cassette 7 may be configured to be attached to and removed from the front of the main body 2. A pick up roller 9 configured to pick up sheets 4 is disposed in a front upper portion of the sheet supply cassette 7. A separation roller 10 and a separation pad 11 are disposed on a downstream side of the pickup roller 9 in a direction where a sheet 4 is fed (hereinafter referred to as a sheet feeding direction). The separation roller 10 and the separation pad 11 are configured to separate the sheets 4 picked up by the pickup roller 9 one by one.

An uppermost sheet 4 in the sheet supply cassette 7 is pressed toward the pickup roller 9 by a known mechanism (not shown), and is singly separated from the stack of sheets 4 in the sheet supply cassette 7 when it is fed between the separation roller 10 and the separation pad 11 by the rotation of the pickup roller 9. The sheet 4 fed from between the separation roller 10 and the separation pad 11 is fed to registration rollers 13 through a pair of conveying rollers 12. The registration rollers 13 convey the sheet 4 at a specified timing onto a belt unit 15 located in a rearward position relative to the registration rollers 13.

The belt unit 15 is configured to be attached to and removed from the main body 2, and includes a pair of belt supporting rollers 16, 17, spaced apart in the front-rear direction, and a conveyor belt 18 horizontally extended between and looped around the belt supporting rollers 16, 17. The conveyor belt 18 is an endless belt made of a resin such as polycarbonate. When the rear belt supporting roller 17 is driven and rotated, the conveyor belt 18 rotates clockwise in FIG. 1 to convey the sheet 4 thereon in a rearward direction. Inside the conveyor belt 18, four transfer rollers 19 are spaced apart at regular intervals in the front-rear direction. The transfer rollers 19 are disposed facing respective photosensitive drums 31 of an image formation unit 26 via the conveyor belt 18. In other words, the conveyor belt 18 is sandwiched between the transfer rollers 19 and the corresponding photosensitive drums 31.

A scanner unit 20 is disposed in an upper portion of the main body 2. An image formation unit such as process section 25 is disposed below the scanner unit 20, and the belt unit 15 is disposed below the process section 25. The scanner unit 20 is configured to irradiate the photosensitive drums 31 with laser light L of each color based on image data in high speed scanning.

The process section 25 may include four image forming units 26 for four colors of black (K), cyan (C), magenta (M), and yellow (Y), which are arranged in the front-rear direction. In alternative implementations, the process section 25 may include one, two, three or more image forming units 26 for a corresponding number of colors. In this illustrative embodiment, the image forming units 26 are arranged in an order of black, yellow, magenta, and cyan, from the front side of the laser printer 1. Each image forming unit 26 includes a photosensitive drum 31, a scorotron charger 32, and a developing cartridge 34.

The photosensitive drum 31 includes a grounded metal drum body and a positively chargeable photosensitive layer formed of polycarbonate coating the drum body. The scorotron charger 32 is disposed diagonally above and away from the corresponding photosensitive drum 31 so as to face the drum. The scorotron charger 32 is configured to generate a corona discharge from a charging wire made of, for example, tungsten and cause the surface of the photosensitive drum 31 to become positively charged uniformly.

The developing cartridge 34 is generally box-shaped, and includes a toner chamber 38 in an upper portion inside and a supply roller 39, a developing roller 40 and a layer-thickness regulating blade 41 under the toner chamber 38. Each toner chamber 38 accommodates a recording material, e.g. non-magnetic one-component toner which is to be positively charged of black, cyan, magenta, or yellow. The toner chamber 38 also includes an agitator 42 for agitating toner.

The supply roller 39 is made by coating a metal roller shaft with a conductive foaming material. The developing roller 40 is made by coating a metal roller shaft with a conductive rubber material. Toner discharged from the toner chamber 38 is supplied to the developing roller 40 by rotation of the supply roller 39, and positively charged between the supply roller 39 and the developing roller 40 by friction. The toner supplied onto the developing roller 40 passes between the layer-thickness regulating blade 41 and the developing roller 40 by the rotation of the developing roller 40, is sufficiently charged by friction therebetween, and carried on the developing roller 40 as a thin layer having a constant thickness.

The surface of the photosensitive drum 31 may be uniformly and positively charged by the scorotron charger 32, and exposed to the laser light L emitted from the scanner unit 20 by high-speed scanning, and an electrostatic latent image is formed based on the image to be formed on the sheet 4. When the developing roller 40 rotates, positively charged toner carried on the developing roller 40 is supplied to the electrostatic latent image formed on the surface of the photosensitive drum 31. Thus, the latent image on the photosensitive drum 31 becomes visible, and a toner image, in which toner is adhered to an exposed area only, is carried on the photosensitive drum 31.

While the sheet 4 that is fed by the conveyor belt 18 passes between each photosensitive drum 31 and its corresponding transfer roller 19, the toner image carried on the surface of each photosensitive drum 31 is successively transferred onto the sheet 4 by a negative bias applied to the corresponding transfer roller 19 during constant current control. The sheet 4 to which four-color toner images have been transferred in this manner is fed to a fixing unit 43.

The fixing unit 43 is disposed at the rear of the conveyor belt 18 in the main body 2. The fixing unit 43 includes a heat roller 44 having a heat source such as a halogen lamp and a pressure roller 45 disposed facing the heat roller 44 so as to press the heat roller 44 from below and configured to be rotated along with the rotation of the heat roller 44. In the fixing unit 43, the sheet 4 having the four-color toner images thereon is heated while it is fed between the heat roller 44 and the pressure roller 45, and the toner images are thermally fixed onto the sheet 4. The sheet 4 on which the toner images have been thermally fixed is sandwiched between an ejection roller 46 and two pinch rollers 47, which are disposed diagonally above the fixing unit 43, and fed therebetween while sheet curling is eliminated. The sheet 4 is further fed between the last ejection roller 48 and two pinch rollers 49 disposed in the upper portion of the main body 2, while sheet curling is eliminated, and is finally ejected to the output tray 5.

The scanner unit 20 includes, in a box-shaped resin housing 50, a polygon motor 51 and a polygon mirror 52 driven by the polygon motor 51. The polygon mirror 52 has six surfaces, for example. In the housing 50, four laser light sources (not shown) are located as follows in the vicinity of the right side of the polygon mirror 52.

A laser light source that emits laser light Lk for black image data is directed to a deflected surface of the polygon mirror 52. The laser light Lk is deflected at the polygon mirror 52, guided to the front side of the laser printer 1, and passes through a first scanning lens (e.g. an fθ lens) 53. The laser light Lk is reflected at reflecting mirrors 54, 55, passes through a second scanning lens 56 (e.g. a toric lens), and is directed onto the surface of the photosensitive drum 31 disposed most frontward.

A laser light source that emits laser light Ly for yellow image data is directed to the same deflected surface of the polygon mirror 52 as for black. The laser light Ly is deflected at the deflected surface, guided to the front side of the laser printer 1, and passes through the first scanning lens 53. The laser light Ly is reflected at reflecting mirrors 57, 58, 59, passes through a second scanning lens 60, and is directed to the surface of the photosensitive drum 31 disposed the second from the front.

A laser light source that emits laser light Lm for magenta image data is directed to a deflected surface of the polygon mirror 52 which is adjacent to the deflected surface to which the laser light sources for the black and magenta image data are directed. The laser light Lm is deflected at the deflected surface, guided to the rear of the laser printer 1, and passes through a first scanning lens 61. The laser light Lm is reflected at reflecting mirrors 62, 63, 64, passes through a second scanning lens 65, and is directed to the surface of the photosensitive drum 31 disposed the third from the front.

A laser light source that emits laser light Lc for cyan image data is directed to the same deflected surface of the polygon mirror 52 as for magenta. The laser light Lc is deflected at the deflected surface, guided to the rear of the laser printer 1, and passes through the first scanning lens 61. The laser light Lc is reflected at reflecting mirrors 66, 67, passes through a second scanning lens 68, and is directed to the surface of the photosensitive drum 31 disposed at the rearmost. Such a structure of the scanner unit 20 is known and disclosed in, e.g. Japanese Laid-Open Publication No. 2007-253480, which is herein incorporated by reference.

A sheet re-feeding mechanism 70 is disposed under the sheet supply cassette 7. The ejection roller 46 is a reversible roller that is configured to rotate in both the normal and reverse directions. The sheet re-feeding mechanism 70 is configured to feed the sheet 4 from the ejection roller 46 back to the conveying rollers 12 as indicated by a phantom line in FIG. 1 when the ejection roller 46 rotates in the reverse direction. The sheet re-feeding mechanism 70 includes a reverse conveyance path 71, a first chute 72, pairs of conveying rollers 73, and a second chute 74. The reverse conveyance path 71 extends in the front-rear direction along the lower surface of the sheet supply cassette 7. The first chute 72 is disposed at the rear end of the sheet re-feeding mechanism 70 and configured to guide the sheet 4 fed down from the ejection roller 46 to the reverse conveyance path 71. The conveying rollers 73 are disposed in the reverse conveyance path 71 and configured to rotate in contact with the sheet 4 and convey it frontward. The second chute 74 is disposed at the front end of the sheet re-feeding mechanism 70 and configured to convey the sheet 4, which is fed to the front end of the reverse conveyance path 71 by the conveying rollers 73, to the conveying rollers 12.

Thus, the sheet 4 having an image, which has been formed in the process section 25, on a first side is fed until the trailing end of the sheet 4 is sandwiched between the ejection roller 46 and the two pinch rollers 47. When the trailing end of the sheet 4 is sandwiched between the ejection roller 46 and the two pinch rollers 47, the ejection roller 46 is caused to rotate in the reverse direction and the sheet re-feeding mechanism 70 feeds the sheet 4 back to the conveying rollers 12, so that a second side of the sheet 4 is ready for image formation.

Figure 2A:
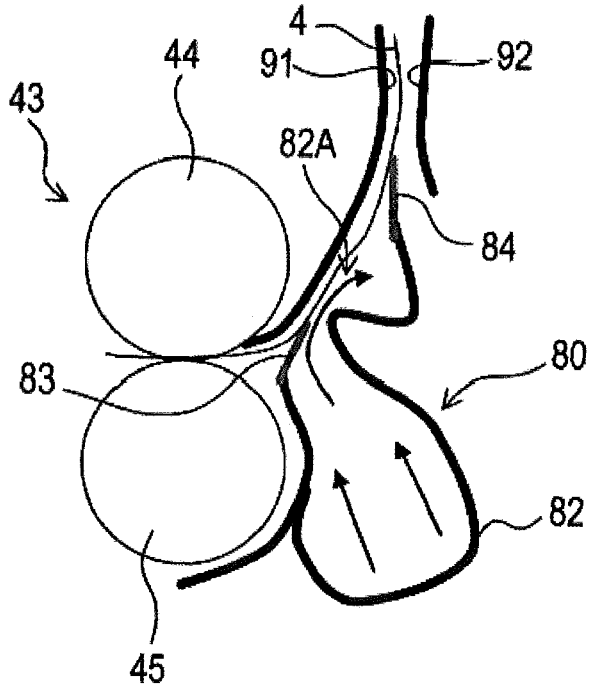
FIGS. 2A and 2B are schematic longitudinal sectional views of an illustrative air blower of the laser printer of FIG. 1.
Figure 2B:
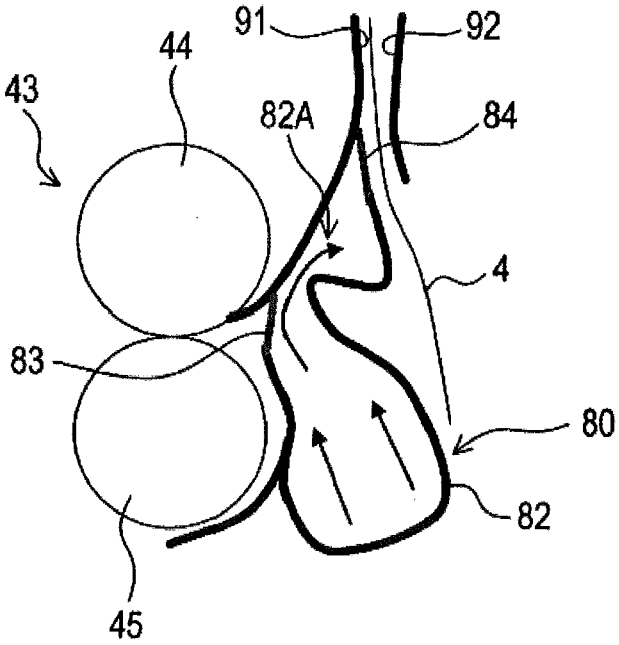
Figure 3:
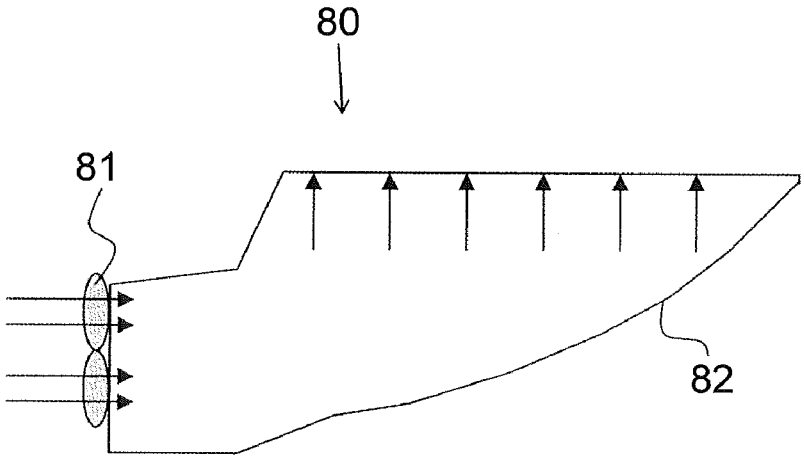
FIG. 3 is a schematic transverse sectional view of the air blower.

An air blower 80 is disposed downstream from the fixing unit 43 in the sheet feeding direction. The air blower 80 is configured to cool the sheet 4 after thermal fixing by the fixing unit 43. As shown in FIG. 3, the air blower 80 includes a fan 81 disposed at a side and a duct 82 for guiding air supplied by the fan 81. As shown in FIGS. 2A and 2B, a guide surface 91 for guiding the sheet 4 from the heat roller 44 to the pinch rollers 47 is disposed above the duct 82. The duct 82 and the guide surface 91 form a passage therebetween. The passage includes an opening 82A that extends in a direction of a width of the recording sheet on the immediate downstream side of the fixing unit 43.

The duct 82 is provided with a flapper 83 at an upstream side of the opening 82A in the sheet feeding direction and a flapper 84 at a downstream side of the opening 82A in the sheet feeding direction. The flappers 83, 84 are movable, e.g. pivotal on their respective shafts extending in the left-right direction between respective open and closed positions. The flappers 83, 84 are driven and caused to pivot by their respective actuators (not shown). When the sheet 4 is ejected from the fixing unit 43, the flappers 83, 84 are caused to pivot toward the closed positions or the downstream side in the sheet feeding direction. As shown in FIG. 2A, the guide surface 91 and the flappers 83, 84 create a clearance through which the sheet 4 can pass. The clearance is hereinafter referred to as a sheet feed path. The sheet 4 is fed along the sheet feed path that is curved to protrude toward the opening 82A in its lengthwise direction. At this time, as indicated by the arrows in FIG. 2A, the flow of air from the fan 81 via the duct 82 is bent along the sheet feeding direction by the flapper 83 that is pivoted to the downstream side, and air passes between the guide surface 91 and the flapper 84.

Thus, air can be blown to the sheet 4 that has been immediately ejected from the fixing unit 43 to cool the sheet 4, so that thermal drying of the sheet 4 that causes moisture on the sheet 4 to evaporate due to heat applied by the fixing unit 43 can be effectively prevented. Further, as the flow of air is bent along the sheet feeding direction by the flapper 83, air does not flow to the fixing unit 43 and interfere with thermal fixing by the fixing unit 43 or conveyance of the sheet 4.

When the ejection roller 46 rotates in the reverse direction to convey the sheet 4 back to the sheet re-feeding mechanism 70, the flappers 83, 84 are pivoted to the upstream side in the sheet feeding direction as shown in FIG. 2B. At this time, the flapper 83 contacts the guide surface 91, which can effectively prevent air from flowing toward the fixing unit 43. In addition, the flapper 84 also contacts the guide surface 91 and an outlet of the sheet feed path is closed. Instead, the flapper 84 and a rear guide surface 92 creates a clearance that is a second sheet feed path through which the sheet 4 can be fed to the sheet re-feeding mechanism 70. At this time, air from the fan 81 is not necessary. The fan 81 may be stopped or the airflow may be reduced.

In the above illustrative embodiment, when duplex printing is performed, the sheet 4 having a first image on a first side can be cooled to prevent thermal drying immediately after it is ejected from the fixing unit 43, so that a second image can be reliably formed on a second side of the sheet 4. In other words, if the sheet 4 having the first image on the first side is thermally dried and electric resistance of the sheet 4 rises too much, the amount of current to be applied through the sheet 4 during image transfer to the second side may be varied from that during image transfer to the first side, and image quality may be worsened. However, according to the above illustrative embodiment, such problems can be avoided with no difficulty in thermal fixing by the fixing unit 43.

In the above illustrative embodiment, air is blown to a protruding side of the sheet 4 being fed in a curved sheet feeding path formed between the guide surface 91 and the flappers 83, 84. Thus, compared with a case where the sheet feeding path is formed linearly, the air blower 80 can be disposed, and air can be blown to the sheet 4 in the immediate vicinity of the fixing unit 43, and thermal drying of the sheet 4 can be effectively prevented.

In addition, the above illustrative embodiment shows that an air exhaust path along which air is exhausted is formed on a downstream side from a position where the sheet 4 is subjected to air from the air blower 80, so that the flow of air along the sheet feeding direction can be smooth. Thus, even when the sheet 4 is subjected to air for cooling in the immediate vicinity of the fixing unit 43, thermal fixing is not disturbed, and thermal drying of the sheet 4 can be more effectively prevented.

Figure 4:
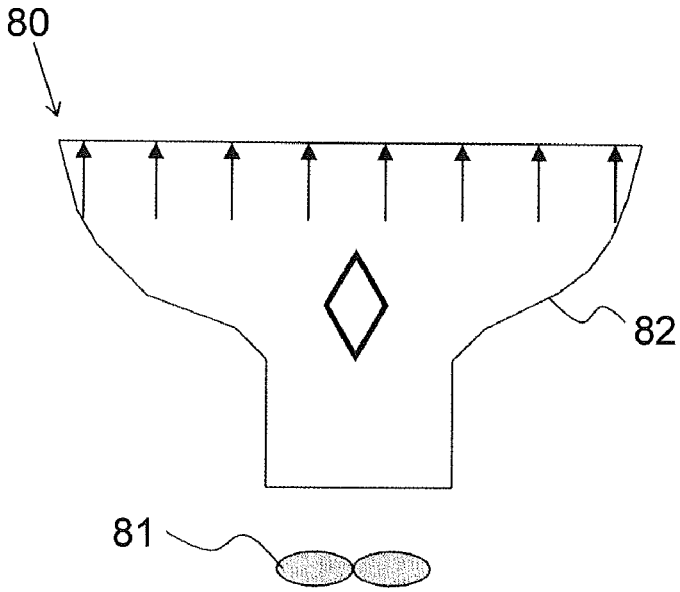
FIG. 4 is a schematic transverse sectional view of the air blower in another illustrative aspect of the invention.

The invention is not limited to the above illustrative embodiment but may be modified in various ways within a scope of the technical idea of the invention. For example, in the above illustrative embodiment, the fan 81 is disposed at the side of the duct 82. However, the fan 81 may be disposed in a lower portion of the duct 82 as shown in FIG. 4, or at the rear of the duct 82. The fan 81 may be a blower fan.

Figure 5A:
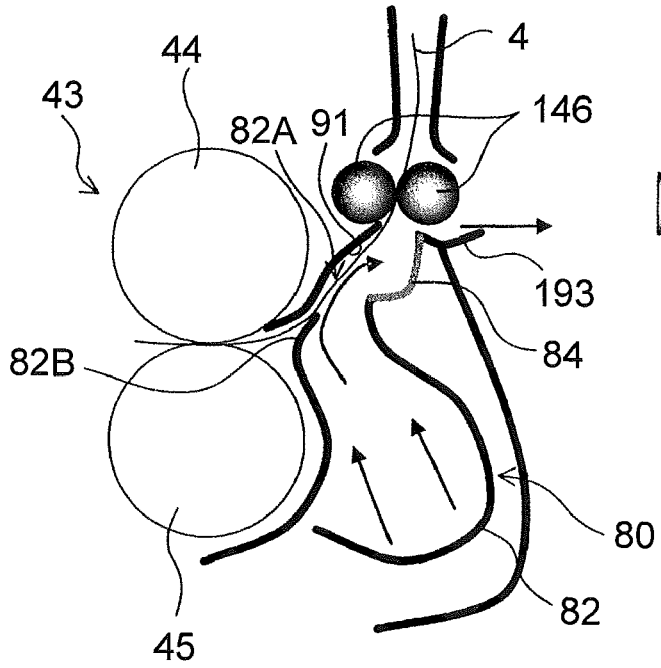
FIGS. 5A and 5B are schematic longitudinal sectional views of a modified air blower according to illustrative aspects.
Figure 5C:
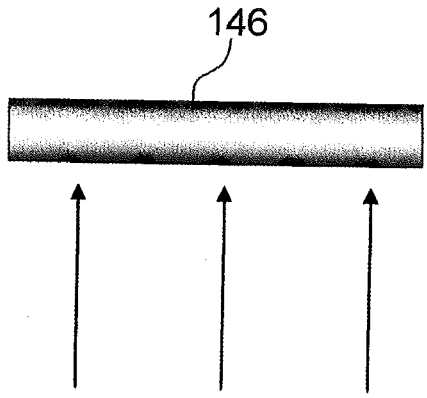
FIG. 5C schematically shows an ejection roller used in the modified air blower of FIGS. 5A and 5B according to illustrative aspects.
Figure 5B:
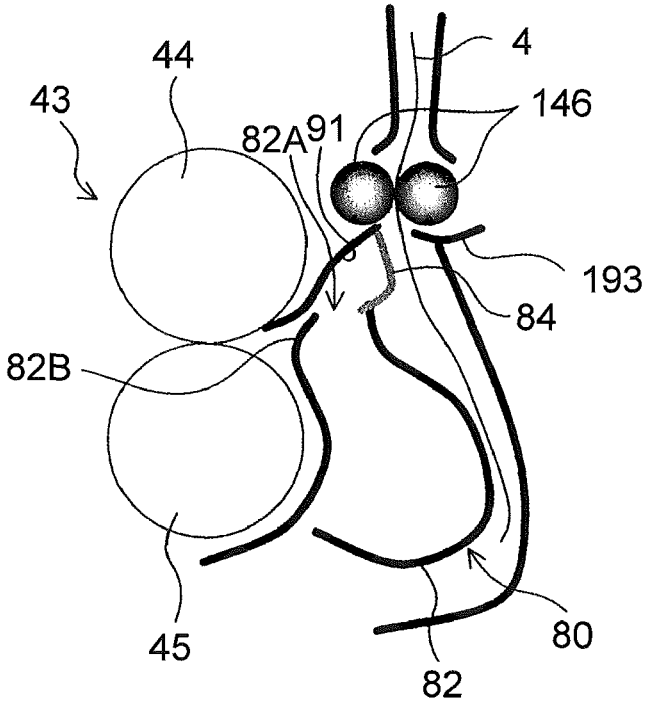

As shown in FIGS. 5A and 5B, a pair of ejection rollers 146 may be disposed on the immediate downstream side of the air blower 80 in the sheet feeding direction, and an air outlet 193 opening toward the rear may be disposed upstream from (or immediately under) the ejection rollers 146. In this modification, the ejection rollers 146 may be made up of a driven roller and a pinch roller that are used as a pair. However, the ejection rollers 146 may be replaced with one large-diameter drive roller or ejection roller 46 and two small-diameter pinch rollers 47 as shown in the above illustrative embodiment.

In this modification, an upstream end 82B of the opening 82A in the duct 82 is curved toward the downstream side in the sheet feeding direction. Even if the flapper 83 is omitted, the flow of air can be bent along the sheet feeding direction, which can prevent air from interfering with thermal fixing by the fixing unit 43. In addition, as shown in FIG. 5C, the ejection rollers 146 can be full-width rollers that extend across the full width of the sheet feeding path. Thus, the following advantages will be obtained in this modification.

When the sheet 4 ejected from the fixing unit 43 is fed to the ejection rollers 146 by causing the flapper 84 to pivot toward the downstream side in the sheet feeding direction as shown in FIG. 5A, air contacting the end 82B is bent along the sheet feeding direction, and passes between the guide surface 91 and the flapper 84. Then, air is blocked by the ejection rollers 146, and emitted from the air outlet 193. The moisture vaporized from the sheet 4 is carried on air, adhered to the ejection rollers 146, and returns back to the sheet 4 when the sheet 4 is fed by the ejection rollers 146. Thus, thermal drying of the sheet 4 can be effectively prevented in this modification.

As shown in FIG. 5B, when the ejection rollers 146 rotate in the reverse direction to convey the sheet 4 to the sheet re-feeding mechanism 70, the flapper 84 pivots toward the upstream side in the sheet feeding direction to guide the sheet 4 to the sheet re-feeding mechanism 70. This is the same behavior as in the case of the above illustrative embodiment. With regard to this point, the following modification has similar behavior as in the case of the above illustrative embodiment.

Figure 6A:
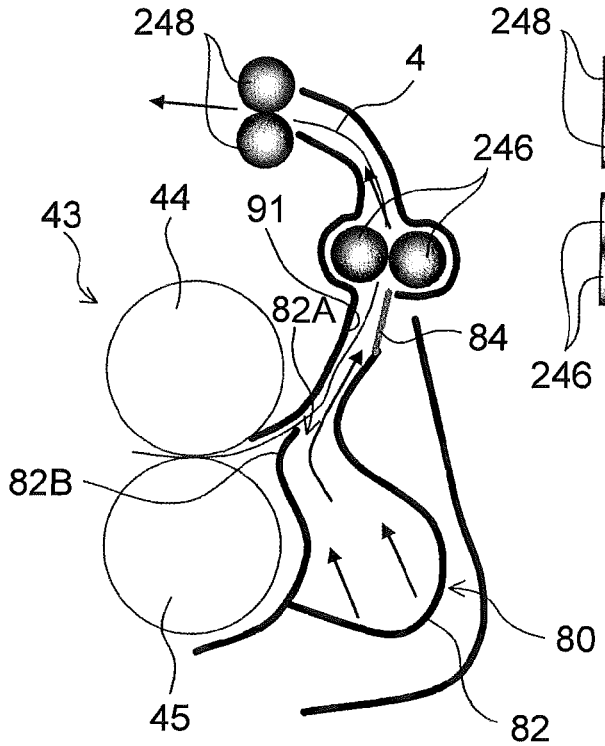
FIGS. 6A and 6B are schematic longitudinal sectional views of a further modified air blower according to illustrative aspects.
Figure 6C:
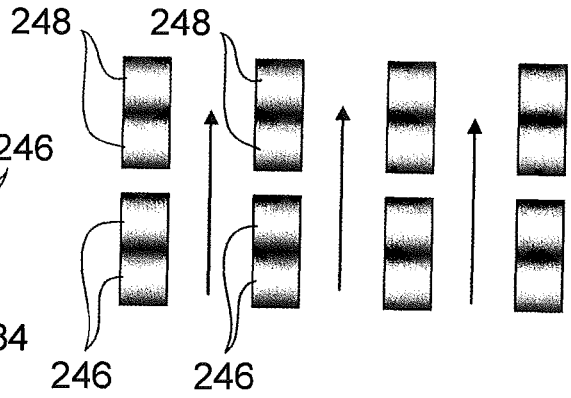
FIG. 6C schematically shows ejection rollers used in the modified air blower of FIGS. 6A and 6B according to illustrative aspects.
Figure 6B:
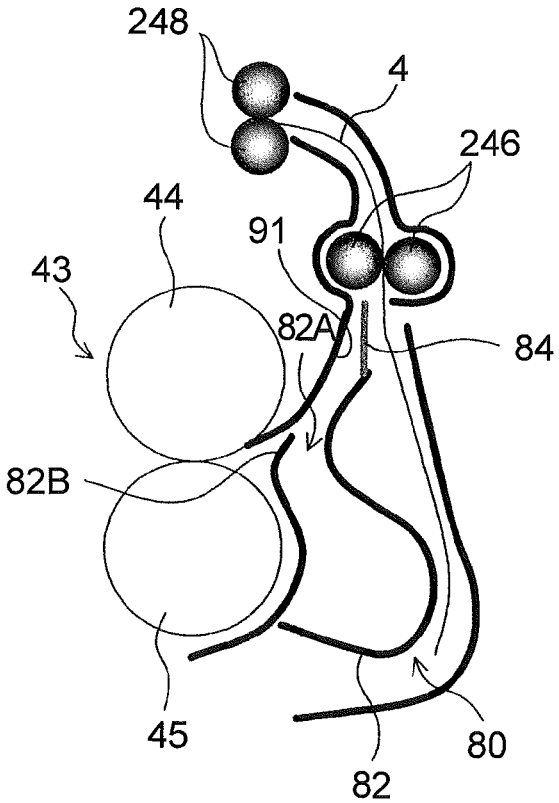

In a modification shown in FIGS. 6A and 6B, a pair of ejection rollers 246 and a pair of ejection rollers 248 are disposed. Each pair of ejection rollers 246 and 248 is axially split into separate rollers having clearances therebetween as shown in FIG. 6C. Thus, air can be conveyed through the clearances. In this modification, the flapper 83 is omitted and instead the upstream end 82B of the opening 82A in the duct 82 is curved toward the downstream side in the sheet feeding direction.

In this modification, when the sheet 4 ejected from the fixing unit 43 is fed to the ejection rollers 246 by causing the flapper 84 to pivot toward the downstream side in the sheet feeding direction, air contacts the end 82B, is bent in the sheet feeding direction, and passes between the guide surface 91 and the flapper 84. Then, air passes through the clearances between the ejection rollers 246 and 248, and is emitted upward from the output tray 5. Thus, the moisture vaporized from the sheet 4 is carried on air and flows along the sheet feeding path, so that thermal drying of the sheet 4 can be more effectively prevented.

Figure 7A:
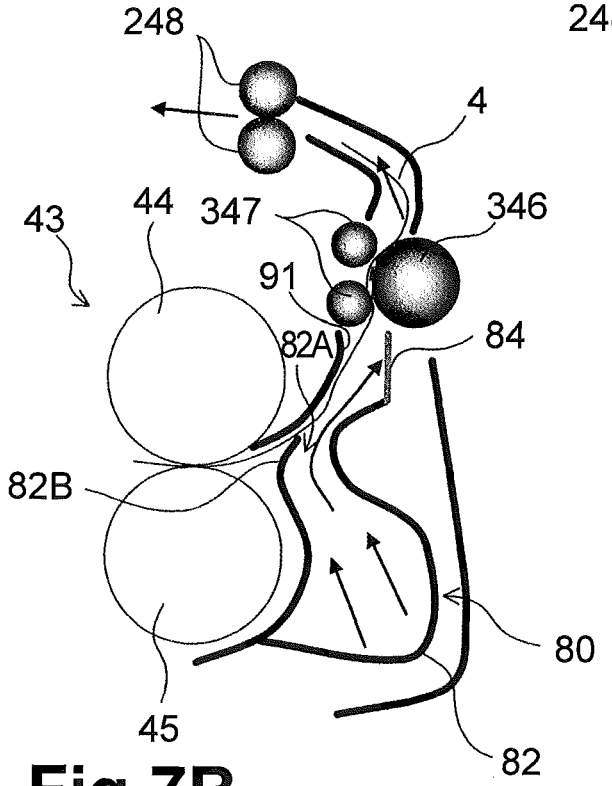
FIGS. 7A and 7B are schematic longitudinal sectional views of a further modified air blower according to illustrative aspects.
Figure 7C:
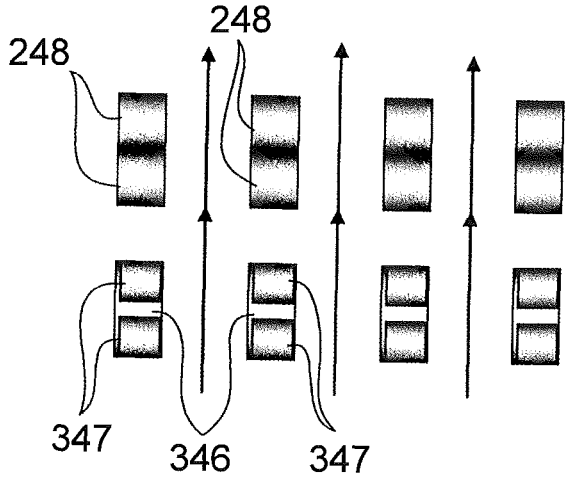
FIG. 7C schematically shows an ejection roller used in the modified air blower of FIGS. 7A and 7B according to illustrative aspects.
Figure 7B:
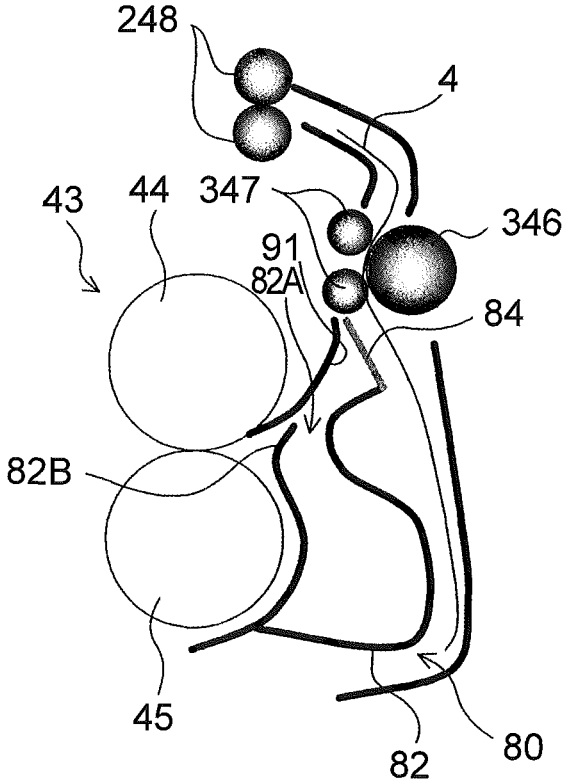

The ejection rollers 246 described above may be replaced with one large-diameter ejection roller 346 and two small-diameter pinch rollers 347, as shown in FIGS. 7A, 7B, and 7C, as in the case of the embodiment shown in FIG. 1. In this modification, as the sheet 4 is sandwiched between the ejection roller 346 and the pinch rollers 347, the sheet curling can be eliminated.

In addition, each modification shown in FIGS. 5A to 7C shows that an air exhaust path along which air is exhausted is formed on a downstream side from a position where the sheet 4 is subjected to air from the air blower 80, so that the flow of air along the sheet feeding direction can be smoother. Thus, even when the sheet 4 is subjected to air for cooling in the immediate vicinity of the fixing unit 43, thermal fixing is not disturbed, and thermal drying of the sheet 4 can be more effectively prevented.

In each modification, air is blown to only the sheet 4 being fed from the fixing unit 43 toward the ejection roller 46 or its equivalent roller disposed downstream from the fixing unit 43. However, air may be blown to the sheet 4 being fed from the ejection roller 46 or its equivalent roller to the sheet re-feeding mechanism 70.

Figure 8A:
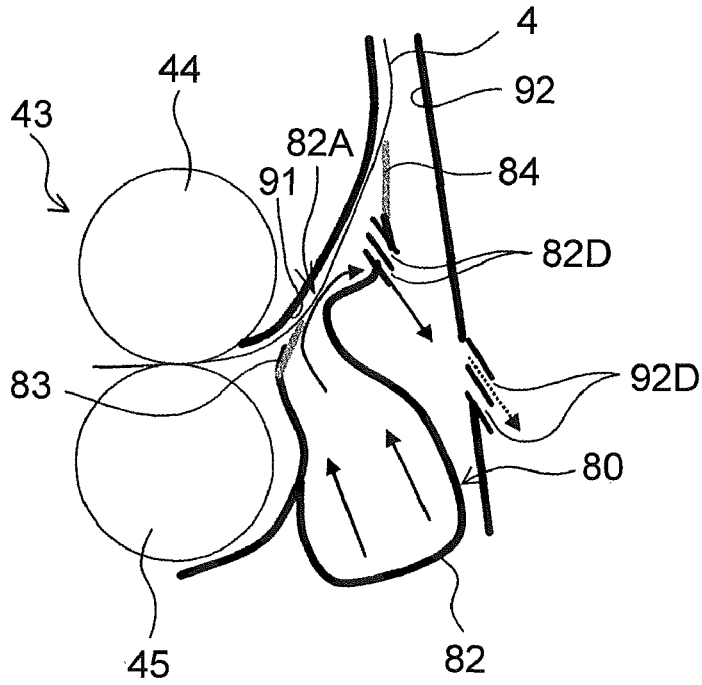
FIGS. 8A and 8B are schematic longitudinal sectional views of a further modified air blower according to illustrative aspects.
Figure 8B:
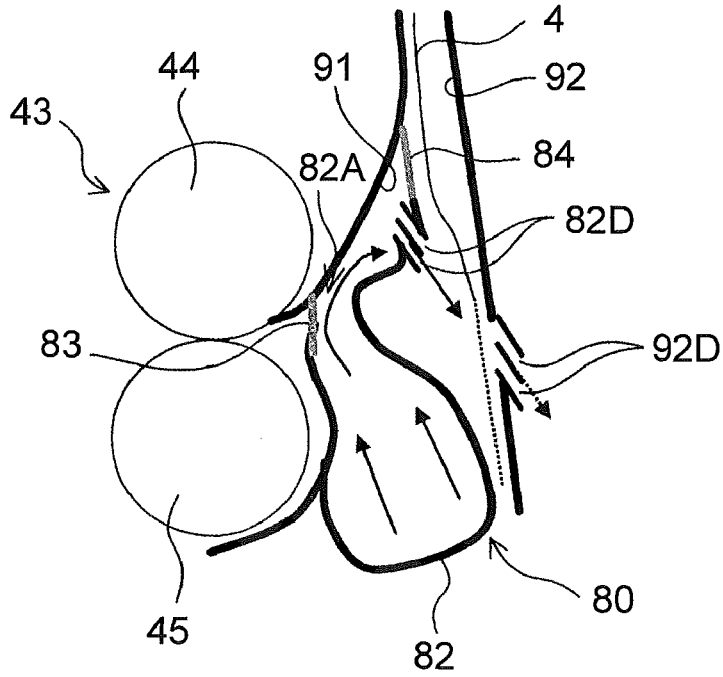

A modification shown in FIGS. 8A and 8B is different from the illustrative embodiment shown in FIG. 2 in that it includes air outlets 82D, 92D. The air outlets 82D, 92D are open diagonally downward toward the rear and formed in the vicinity of a downstream end of the opening 82A of the duct 82 and the guide surface 92, respectively. In this case, as indicated by arrows in FIGS. 8A and 8B, air bent along the sheet feeding direction by the flapper 83 is exhausted from the air outlets 82D, 92D. Thus, as shown in FIG. 8B, air can be blown to the sheet 4 fed from the ejection roller 46 toward the sheet re-feeding mechanism 70 along its conveying direction, and the sheet 4 can be more effectively cooled.

Figure 9A:
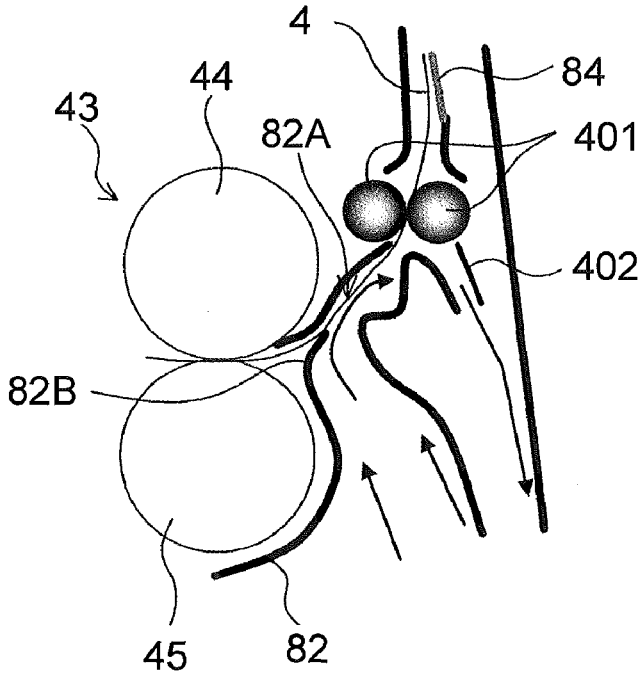
FIGS. 9A and 9B are schematic longitudinal sectional views of a further modified air blower according to illustrative aspects.
Figure 9C:
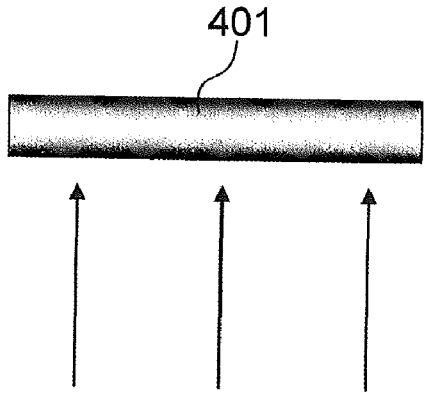
FIG. 9C schematically shows an ejection roller used in the modified air blower of FIGS. 9A and 9B according to illustrative aspects.
Figure 9B:
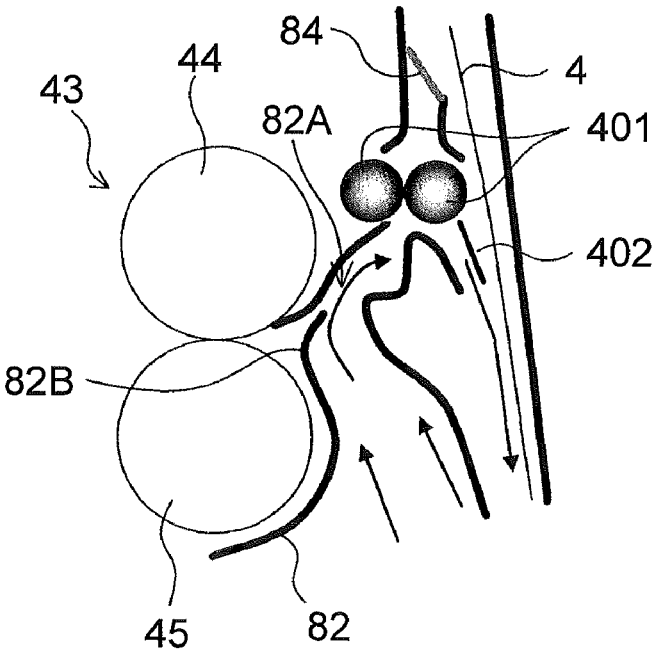

As shown in FIGS. 9A, 9B, and 9C, a pair of conveying rollers 401 which are full width rollers may be disposed between the opening 82A of the duct 82 and the flapper 84 that changes the conveying direction of the sheet 4. In addition, an air outlet 402 that is configured to exhaust air blocked by the conveying rollers 401 toward the sheet re-feeding mechanism 70 may be provided. In this modification, the flow of air is bent along the sheet feeding direction by making the upstream end 82B of the opening 82A in the duct 82 curved toward the downstream side in the sheet feeding direction, as in the case of the modifications shown in FIGS. 5A to 7C. In this modification, air bent along the sheet feeding direction by the upstream end 82B can be blocked by the ejection rollers 401, then exhausted from the air outlet 402, and blown to the sheet 4 fed from the ejection roller 46 toward the sheet re-feeding mechanism 70 along the sheet feeding direction. In addition, as in the case of the modification shown in FIGS. 5A to 5C, the moisture evaporated from the sheet 4 can be carried on air and adhered to the ejection rollers 401 and returned back to the sheet 4 when the sheet 4 is fed by the ejection rollers 401. Thus, thermal drying of the sheet 4 can be effectively prevented.

Figure 10A:
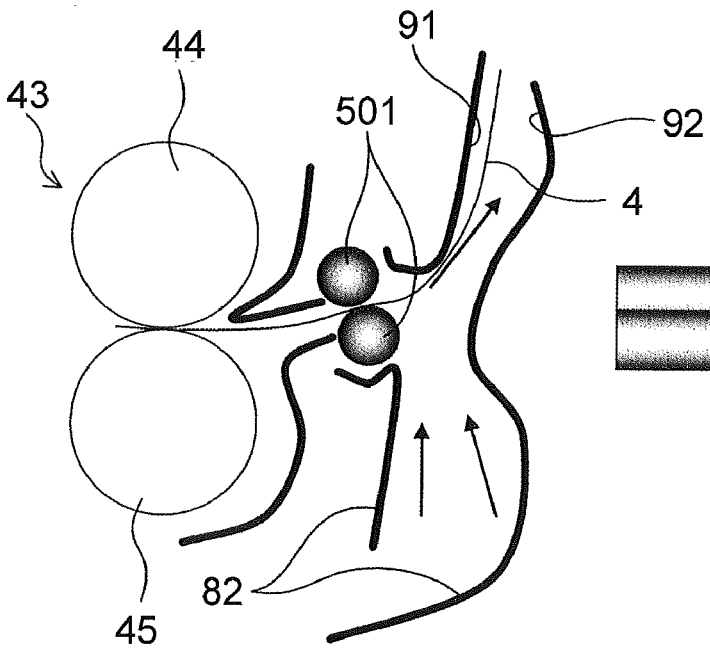
FIGS. 10A and 10B are schematic longitudinal sectional views of a further modified air blower according to illustrative aspects.
Figure 10C:
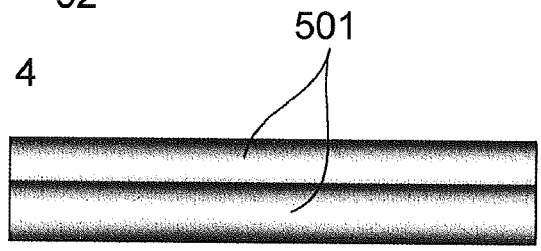
FIG. 10C schematically shows conveying rollers used in the modified air blower of FIGS. 10A and 10B according to illustrative aspects.
Figure 10B:
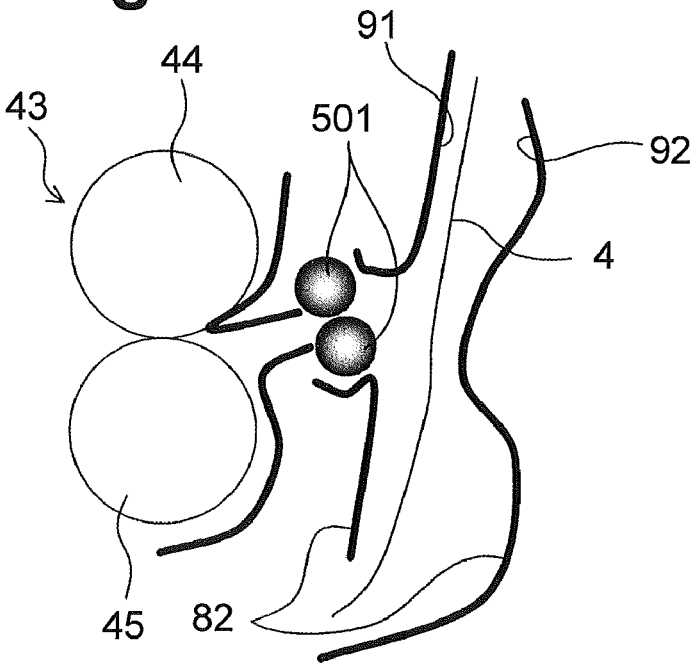

In each above-described modification, the end 82B or the flapper 83 regulates the flow of air so that air does not flow toward the fixing unit 43. However, the structure to regulate the flow of air is not limited to the end 82B or the flapper 83. For example, as shown in FIGS. 10A, 10B, and 10C, a pair of conveying rollers 501 which are full width rollers may be disposed near an exit of the fixing unit 43 to prevent air from flowing toward the fixing unit 43. In this modification, the front and rear wall surfaces of the duct 82 are continuously formed with the guide surfaces 91, 92, so that the sheet 4 is fed through the duct 82 toward the sheet re-feeding mechanism 70, as shown in FIG. 10B.

The illustrative embodiments show, but are not limited to, the direct-tandem type color laser printer. It will be appreciated that the illustrative embodiments also apply to other types of electrostatic and electrophotographic image forming apparatuses including, but not limited to, an intermediate transfer type color laser printer, four-cycle color laser printer, a monochrome printer, LED printer and an LCD shutter printer. In addition, development may be performed with not only single component development method but also two-component development method. Further, the sheet re-feeding mechanism 70 may not be limited for duplex printing usage, but may be configured to form multiple images overlapped one another on the same side of the sheet 4.

While the features herein have been described in connection with various example structures and illustrative aspects, it will be understood by those skilled in the art that other variations and modifications of the structures and aspects described above may be made without departing from the scope of the inventions described herein. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. An image forming apparatus comprising:

an image formation unit configured to form an image on a recording sheet;

a fixing unit disposed downstream from the image formation unit in a sheet feeding direction, the fixing unit being configured to fix the image onto the recording sheet;

a passage including a guide member and a duct member, the passage defining a path between the guide member and the duct member, the path having an inlet extending in a widthwise direction of the recording sheet, the inlet provided immediately downstream from the fixing unit in the sheet feeding direction;

a fan coupled to the passage and being configured to supply air into the path; and a preventing device configured to prevent air supplied by the fan from flowing to the fixing unit, wherein the fixing unit feeds the recording sheet having the image thereon through the inlet to the path and the passage has a shape to guide air in the path in the sheet feeding direction.

2. The image forming apparatus according to claim 1, wherein the preventing device includes a part of the passage.

3. The image forming apparatus according to claim 1, wherein the preventing device includes a pair of rollers.

4. The image forming apparatus according to claim 1, wherein the guide member is curved such that the path is curved.

5. The image forming apparatus according to claim 1, wherein the image formation unit electrophotographically forms an image on a recording sheet using a transfer current applied through the recording sheet.

6. An image forming apparatus comprising:

an image formation unit configured to form an image on a recording sheet;

a fixing unit disposed downstream from the image formation unit in a sheet feeding direction, the fixing unit being configured to fix the image onto the recording sheet;

a passage including a guide member and a duct member, the passage defining a path between the guide member and the duct member, the path having an inlet provided immediately downstream from the fixing unit in the sheet feeding direction;

a movable member configured to open and close the inlet; and a fan coupled to the passage and being configured to supply air into the path, wherein the fixing unit feeds the recording sheet having the image thereon through the inlet to the path and the passage has a shape to guide air in the path in the sheet feeding direction.

7. The image forming apparatus according to claim 1, further comprising a preventing device configured to prevent air supplied by the fan from flowing to the fixing unit.

8. The image forming apparatus according to claim 6, wherein the movable member includes a flapper configured to pivotally move between open and closed positions.

9. An image forming apparatus comprising:

an image formation unit configured to form an image on a recording sheet;

a fixing unit disposed downstream from the image formation unit in a sheet feeding direction, the fixing unit being configured to fix the image onto the recording sheet;

a passage including a guide member and a duct member, the passage defining a path between the guide member and the duct member, the path having an inlet provided downstream from the fixing unit in the sheet feeding direction;

a movable member disposed on a downstream side of the path in the sheet feeding direction, the movable member being configured to open and close an outlet of the path; and a fan coupled to the passage and being configured to supply air into the path, wherein the fixing unit feeds the recording sheet having the image thereon through the inlet to the path and the passage has a shape to guide air in the path in the sheet feeding direction.

10. The image forming apparatus according to claim 9, wherein the movable member includes a flapper configured to pivotally move between open and closed positions.

11. The image forming apparatus according to claim 9, further comprising a sheet guide surface defining a second path, wherein when the movable member closes the outlet of the path, an inlet of the second path is formed.

12. The image forming apparatus according to claim 11, further comprising a sheet re-feeding mechanism configured to re-feed the recording sheet having the image thereon through the second path to the image formation unit.

13. The image forming apparatus according to claim 11, further comprising means for re-feeding the recording sheet having the image thereon through the second path to the image formation unit.

14. An image forming apparatus comprising:

image forming means for forming an image on a recording sheet;

fixing means for fixing the image formed by the image forming means on the recording sheet;

reversing means for receiving the sheet from the fixing means along a sheet transport path and reversing a transport direction of the sheet;

a passage defining the sheet transport path, the sheet transport path having an inlet provided downstream from the fixing unit in the sheet feeding direction;

a movable member disposed on a downstream side of the path in the sheet feeding direction, the movable member being configured to open and close an outlet of the path; and air blowing means, coupled to the passage, for blowing air, in a sheet feeding direction into the sheet transport path, onto the recording sheet on which the image is fixed by the fixing means.

15. The image forming apparatus according to claim 14, further comprising means for preventing air supplied by the fan from flowing to the fixing unit.

16. The image forming apparatus according to claim 14, wherein the movable member includes a flapper configured to pivotally move between open and closed positions.

17. The image forming apparatus according to claim 14, further comprising a preventing device configured to prevent air supplied by the fan from flowing to the fixing unit.

18. An image forming apparatus comprising:

an image formation unit configured to form an image on a recording sheet;

a fixing unit configured to fix the image formed by the image formation unit on the recording sheet;

a reversible roller configured to receive the sheet from the fixing unit along a sheet transport path and reverse a transport direction of the sheet;

a passage defining the sheet transport path, the sheet transport path having an inlet provided immediately downstream from the fixing unit in the sheet feeding direction;

a movable member configured to open and close the inlet; and an air blower, coupled to the passage, configured to blow air in a sheet feeding direction into the sheet transport path onto the recording sheet on which the image is fixed by the fixing unit.

19. The image forming apparatus according to claim 18, further comprising a preventing device configured to prevent air supplied by the fan from flowing to the fixing unit.

20. The image forming apparatus according to claim 18, wherein the movable member includes a flapper configured to pivotally move between open and closed positions.

* * * * *